US009545935B2

(12) United States Patent
Liberatore

(10) Patent No.: US 9,545,935 B2
(45) Date of Patent: Jan. 17, 2017

(54) SYSTEM AND METHOD FOR INTERFACING WITH A PORTABLE REMOTE SPEED CONTROL SYSTEM ON A LOCOMOTIVE TO ENHANCE SPEED CONTROL AND A SPEED MEASUREMENT DEVICE THEREFOR

(75) Inventor: Aldo Liberatore, London (CA)

(73) Assignee: ZTR Control Systems, London (CA)

( * ) Notice: Subject to any disclaimer, the term of this patent is extended or adjusted under 35 U.S.C. 154(b) by 236 days.

(21) Appl. No.: 13/586,482

(22) Filed: Aug. 15, 2012

(65) Prior Publication Data

US 2013/0066490 A1 Mar. 14, 2013

Related U.S. Application Data

(60) Provisional application No. 61/534,820, filed on Sep. 14, 2011.

(51) Int. Cl.

| | |
|---|---|
| ***B61L 3/12*** | (2006.01) |
| *B61L 25/02* | (2006.01) |
| *B61L 15/00* | (2006.01) |

(52) U.S. Cl.

CPC ..... *B61L 3/127* (2013.01); *B61L 15/0036* (2013.01); *B61L 25/021* (2013.01)

(58) Field of Classification Search

CPC ..... B61L 3/127; B61L 15/0036

USPC ..... 701/20; 246/182 R

See application file for complete search history.

(56) References Cited

U.S. PATENT DOCUMENTS

| | | | | |
|---|---|---|---|---|
| 1,634,565 | A * | 7/1927 | Wallbillich | 74/12 |
| 5,589,767 | A * | 12/1996 | Akamatsu | G01P 3/481 246/249 |
| 6,672,681 | B1 * | 1/2004 | Moretti et al. | 301/109 |
| 2011/0245998 | A1 * | 10/2011 | Ecton | B61L 3/127 701/2 |
| 2012/0136515 | A1 * | 5/2012 | Noffsinger | B61L 15/0027 701/19 |

* cited by examiner

*Primary Examiner* — Basil T Jos

(74) *Attorney, Agent, or Firm* — Brett J. Slaney; Blake, Cassels & Graydon LLP

(57) ABSTRACT

A portable mounting assembly is provided comprising a mounting disc comprising at least one magnetic component for attaching the mounting disc to an axle bearing on a vehicle such as a locomotive, for determining speed; and a stabilizer bar attached at a first end to the mounting disc and at a second end to an outrigger comprising at least one magnetic component for attaching to a stationary component of the vehicle. A method of providing speed control to a portable remote control system for a locomotive is also provided. A method of overriding a speed control mode operated by a portable remote control system for a locomotive is also provided.

15 Claims, 17 Drawing Sheets

SYSTEM AND METHOD FOR INTERFACING WITH A PORTABLE REMOTE SPEED CONTROL SYSTEM ON A LOCOMOTIVE TO ENHANCE SPEED CONTROL AND A SPEED MEASUREMENT DEVICE THEREFOR

This application claims priority to U.S. Provisional Patent Application No. 61/534,820 filed on Sep. 14, 2011, the entire contents of which are incorporated herein by reference.

TECHNICAL FIELD

The following relates to systems and methods for interfacing with portable remote speed control systems on locomotives to enhance speed control and speed measurement devices therefor.

DESCRIPTION OF THE RELATED ART

Locomotives may be equipped with remote control systems to control the speed and/or throttle and brakes of the locomotive. Such systems are commonly used throughout the rail industry in rail yards to empower operators to control the locomotives without necessarily having an operator on board. This may be done for safety concerns and/or to improve railroad efficiencies. Most commonly, the remote control system is permanently installed to integrate the remote control features with the locomotive's existing control system.

Remote control systems also exist which are portable and can be transferred from one locomotive to another. This type of remote control system normally includes two components, namely a receiver module, often referred to as a Locomotive Control Unit (LCU), and a handheld human machine interface (HMI) such as a controller, often referred to as a Operator Control Unit (OCU).

Locomotives are typically capable of multiple unit or "multi-unit" (MU) operation as a means of increasing horsepower and tractive effort when hauling heavy trains. As part of the interchange requirements, North American locomotives use a standardized Association of American Railroads (AAR) electrical control and pneumatic interconnections. The electrical control system interconnection is via a 27-pin jumper cable between the locomotives. The electrical wires that are common within all locomotives used to control traction, horsepower, braking and other auxiliary functions are known as the trainline. The MU cable that interconnects the locomotives provides an electrical harness that allows one locomotive to control others. The pneumatic interconnections between locomotives is typically accomplished using 4 hoses. These pneumatic interfaces provide the lead locomotive with the capability of controlling the train's brakes and controlling any trailing locomotives' brakes.

A set of locomotives under MU control is referred to as a consist. When operating in a consist, one of the locomotives in the consist, typically the one in front, is configured as the lead locomotive, while the other locomotive(s) in the consist are referred to as trailing locomotives. When the operator controls the lead locomotive, the trailing locomotive(s) mimic(s) the actions of the lead locomotive, through signals sent via the trainline harness and hoses.

As shown in FIG. 1, in portable remote control systems 10, a Locomotive Control Unit (LCU) 12 controlled by a handheld Operator Control Unit (OCU) 14 via a wireless connection 16, is able to interface with the locomotive's electrical control system (not shown), by providing an MU plug 20 configured to plug into the locomotive's MU receptacle 22, shown in FIG. 2. When plugged into the locomotive's MU receptacle 22, the OCU 12 can supply commands to the locomotive it is connected to via one or more of the twenty seven (27) pins provided by the MU receptacle 22, as though it were a lead locomotive. As shown in FIG. 1, the LCU 12 also includes a pneumatic interface 18 to interface with the locomotive's braking system.

Current portable remote control systems 10 are designed to only control the throttle position of the locomotive and the braking separately. This places limits on the ability of portable remote control systems 10 to offer effective and portable speed control. Since horsepower control is typically limited to increasing and decreasing between a set of eight (8) throttle or horsepower positions, it can be extremely difficult to control the speed of a locomotive, particularly high horsepower locomotives, where the difference between throttle positions can be several hundred horsepower.

It is therefore an object of the following to address the above-noted disadvantages.

SUMMARY

It has been realized that whereas permanently mounted remote control systems have access to speed signals and can control the excitation output of the locomotive's generator, current portable remote control systems for locomotives provide only coarse speed control by requesting horsepower targets using notch settings. This is due to limited or cumbersome access to the locomotive's built in speed signals, whether axle generators, traction motor probes, or radar. The following provides a system that can interface between commercially available portable remote control systems 10 and the locomotive to provide effective and safe speed control by using the remote control system's interface with an MU receptacle 22 to access and provide signals over a speed control wire. The system can retrofit existing commercial portable remote control systems 10 or integrate therewith to provide enhanced speed control in a portable remote locomotive control application.

It has also been found that the speed of a locomotive can be determined by attaching an encoder directly to an axle bearing and transmitting a speed reading to a speed control module that interfaces with the remote control receiver. A bearing bracket assembly is described below, which can support an encoder or other suitable device used to determine a speed of the locomotive, not only for interfacing with portable speed control systems, but for any purpose where a speed reading is desired.

The bearing bracket assembly can also be used with a generator to use rotation of the axle bearing to generate electricity for on-board uses, particularly in train cars that do not have an existing power source.

In one aspect, there is provided a mounting assembly comprising a mounting disc comprising at least one magnetic component for attaching the mounting disc to an axle bearing on a vehicle, a stabilizer bar attached at a first end to the mounting disc and at a second end to an outrigger comprising at least one magnetic component for attaching to a stationary component of the vehicle.

In another aspect, there is provided a speed measurement device comprising an encoder connected to the mounting assembly.

In yet another aspect, there is provided an electrical power generator device comprising a generator connected to the mounting assembly.

In yet another aspect, there is provided a method of providing speed control to a portable remote control system for a locomotive, the method comprising: obtaining a target speed from a remote control receiver of the portable remote control system; and using a connection to a trainline on the locomotive provided by the remote control receiver to provide a speed control signal to a locomotive control system.

In yet another aspect, there is provided a method of overriding a speed control mode operated by a portable remote control system for a locomotive, the method comprising: obtaining a measured speed from a speed measurement device interfaced with the locomotive; comparing the measured speed to a target speed provided by the portable remote control system; and providing an emergency stop instruction to the portable remote control system when the measured speed exceeds the target speed.

In yet another aspect, there is provided a computer readable storage medium comprising computer executable instructions for performing the above methods.

In yet another aspect, there is provided a speed control module comprising a controller configured to perform the above methods.

BRIEF DESCRIPTION OF THE DRAWINGS

Embodiments will now be described by way of example only with reference to the appended drawings wherein.

DETAILED DESCRIPTION

Figure 1:
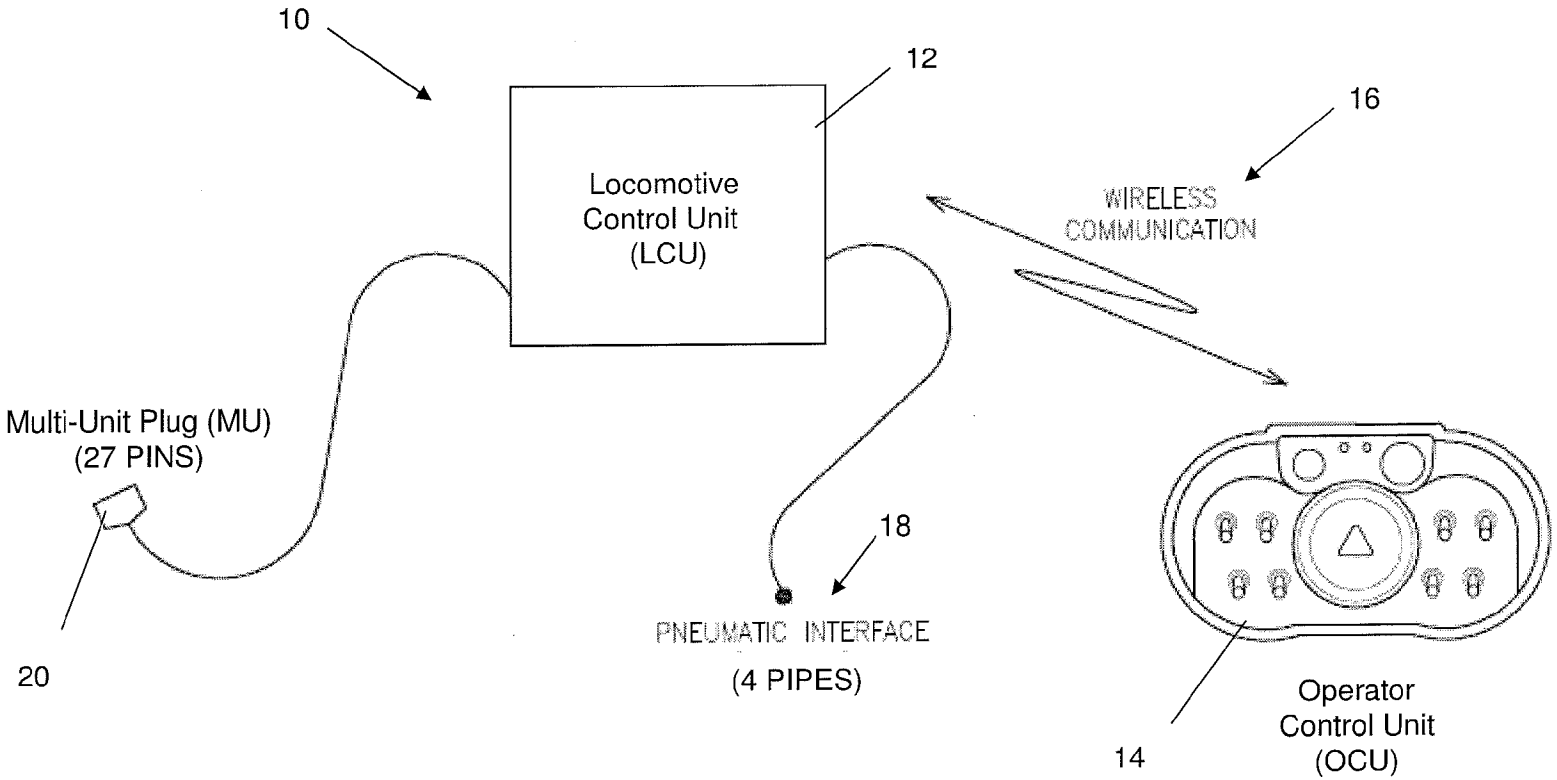
FIG. 1 is a schematic diagram of a portable remote control system for a locomotive.
Figure 2:
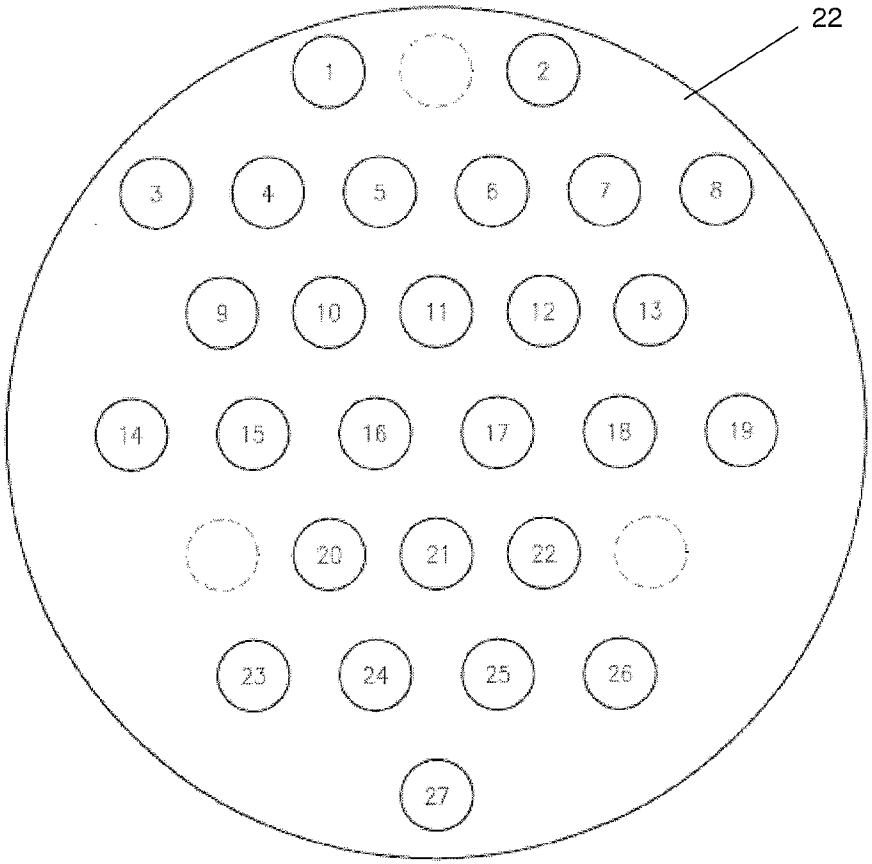
FIG. 2 is a schematic diagram of a multiple unit (MU) receptacle for a locomotive.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures and components have not been described in detail so as not to obscure the example embodiments described herein. Also, the description is not to be considered as limiting the scope of the example embodiments described herein.

Many heavy haul locomotives, i.e. locomotives designed for long distance heavy freight service, are equipped with internal slow speed setting controls. These are often used during loading and unloading cycles for commodities such as coal, iron ore and wheat. As well, in many yards, dedicated locomotives are used to push cars up a hill, also known as a hump, at a controlled speed to organize cars into trains. In both cases, when the operator sets the lead locomotive in a consist to operate in the slow speed control mode, a dedicated processor and/or control code has the capability of controlling the throttle notches of the locomotive and the excitation level of the traction alternator to attain the desired speed set point. The methodology of performing this control incorporates the use of two trainlined wires. On most railroads, these wires are found on Pin 1 and Pin 24 of the MU receptacle and are designated as 1T and 24T. When appropriately set-up to respond to slow speed commands, the locomotive will interpret the 1T wire as a slow speed enable signal. If the voltage level on this wire is 72 VDC, the locomotive will respond to the variable 24T voltage by raising or lowering the excitation current of the traction alternator proportionally. It may be noted that during normal operation, the 24T wire is used to control dynamic braking effort and thus in the examples provided below, when configured in slow speed control mode the dynamic braking control is disabled.

While there are different configurations, it is common for the voltage on the 24T wire to vary from 0 to 50 volts DC and for this voltage to represent 0-100% excitation of the traction alternator. Based on the targeted speed set point, the speed control module's microprocessor adjusts the excitation of the traction alternator to account for varying tonnage being pulled (loading or unloading), changing grades or track curvature, etc., to maintain a constant speed.

It has been recognized that by configuring a locomotive's control system to operate in a speed control mode via the 24T and the 1T wire, and by utilizing the MU connection provided by a portable remote control system's remote control receiver 12, the portable remote control system 10 can be retrofitted or otherwise adapted or configured to provide portable remote speed control. In this way, the portable remote control system 10 can provide finer remote control over a locomotive's speed than by simply controlling notch settings to achieve horsepower targets.

Figure 3:
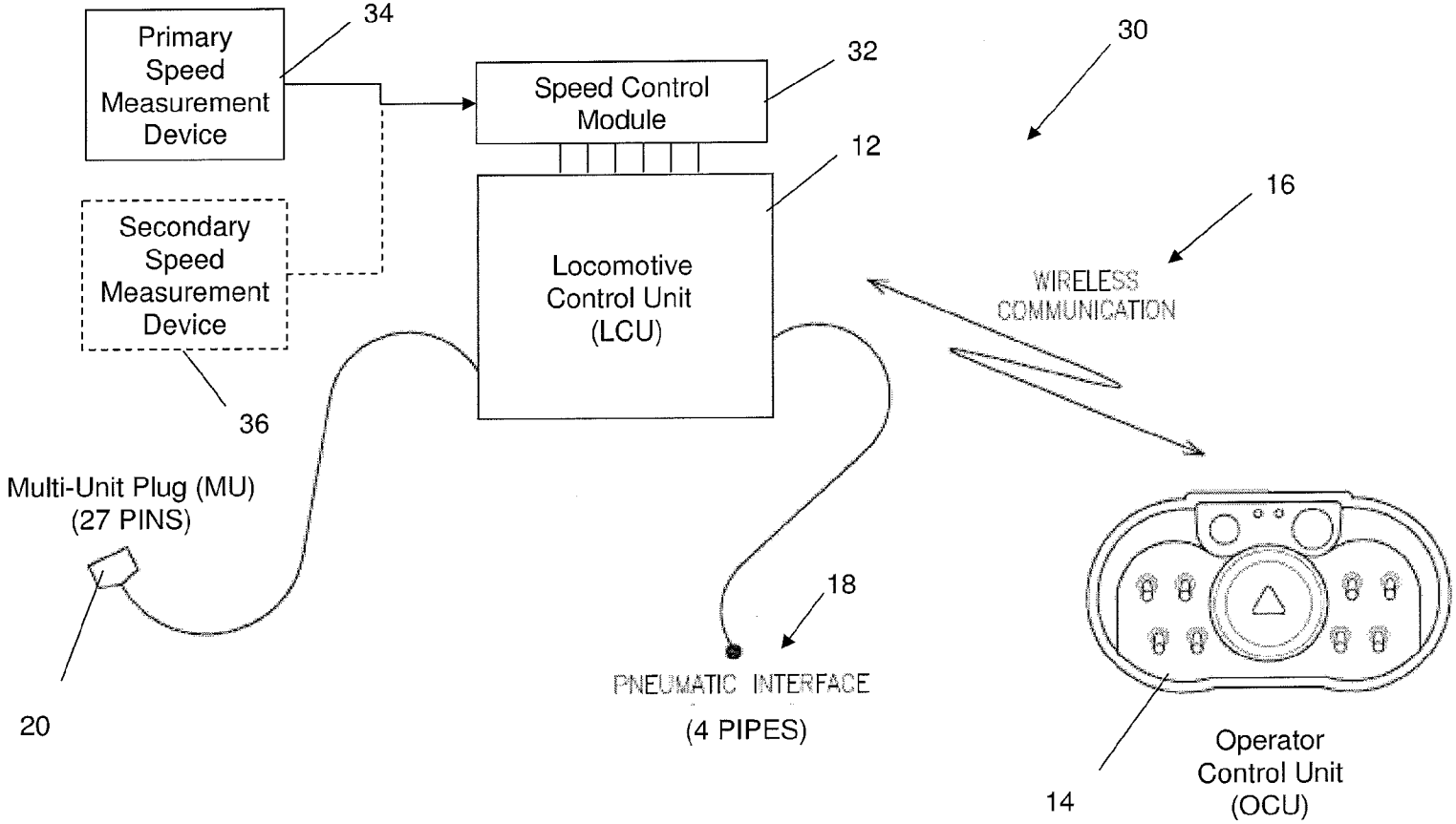
FIG. 3 is a schematic diagram of a portable remote control system for a locomotive retrofitted with a speed control module.

It has also been recognized that a requirement of effective speed control is a reliable and accurate speed signal 48 (see also FIG. 5 discussed below) from a speed measurement device, either existing on the locomotive or portably attached thereto, FIG. 3 illustrates an example of a configuration wherein a speed control module 32 is used to interface with the remote control receiver 12 of an existing portable remote control system 10. The speed control module 32 in this example also interfaces with a primary portable speed measurement device 34 such as an encoder 66 mounted on a locomotive bearing (see FIG. 6 discussed below), a Doppler speed radar 34*a* (see FIG. 15 discussed below), global positioning system (GPS) unit, etc., to obtain an actual or "true" speed reference. To provide redundancy and/or a safety backup, a secondary portable speed measurement device 36 may also be referenced, e.g., to confirm that the primary portable speed measurement device 34 is working properly and/or to provide a true speed reference in the event that the primary speed measurement device 34 is inoperable or incommunicable. It can be appreciated that the secondary speed measurement device 36 may be of the same type as the primary speed measurement device 34 or may be of a different type. For example, two bearing bracket assembly type devices 34*a* (see FIG. 6) may be used, or one bearing bracket assembly type device 34*a* and a GPS unit, etc.

Figure 4:
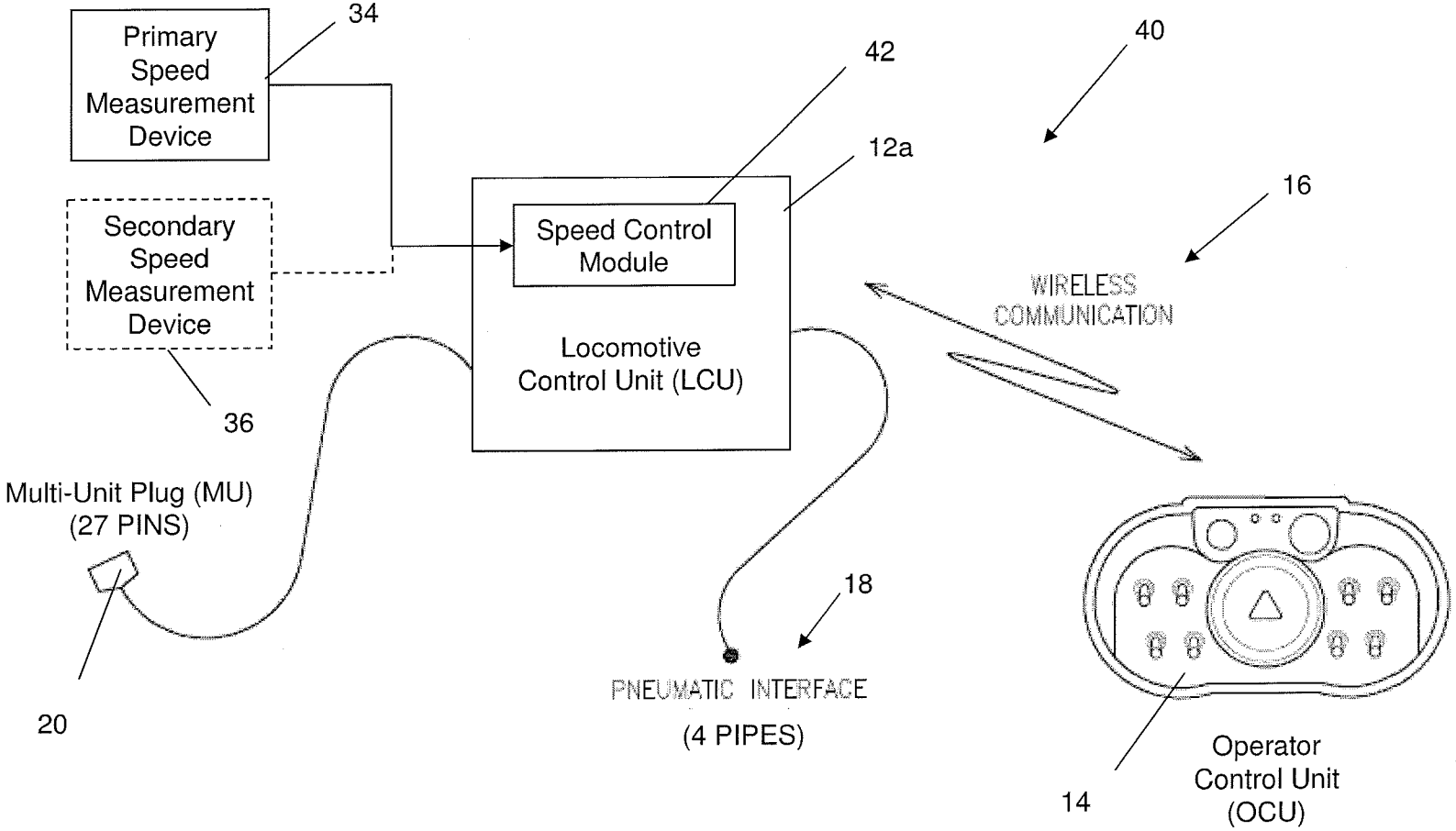
FIG. 4 is a schematic diagram of a portable remote control system for a locomotive including a speed control module.

FIG. 4 illustrates an example of a configuration wherein a remote control receiver 12*a* is designed with or otherwise incorporates or provides an internal speed control module 42. It can be appreciated that both configurations shown in FIGS. 3 and 4 may operate according to the principles below.

Figure 5:
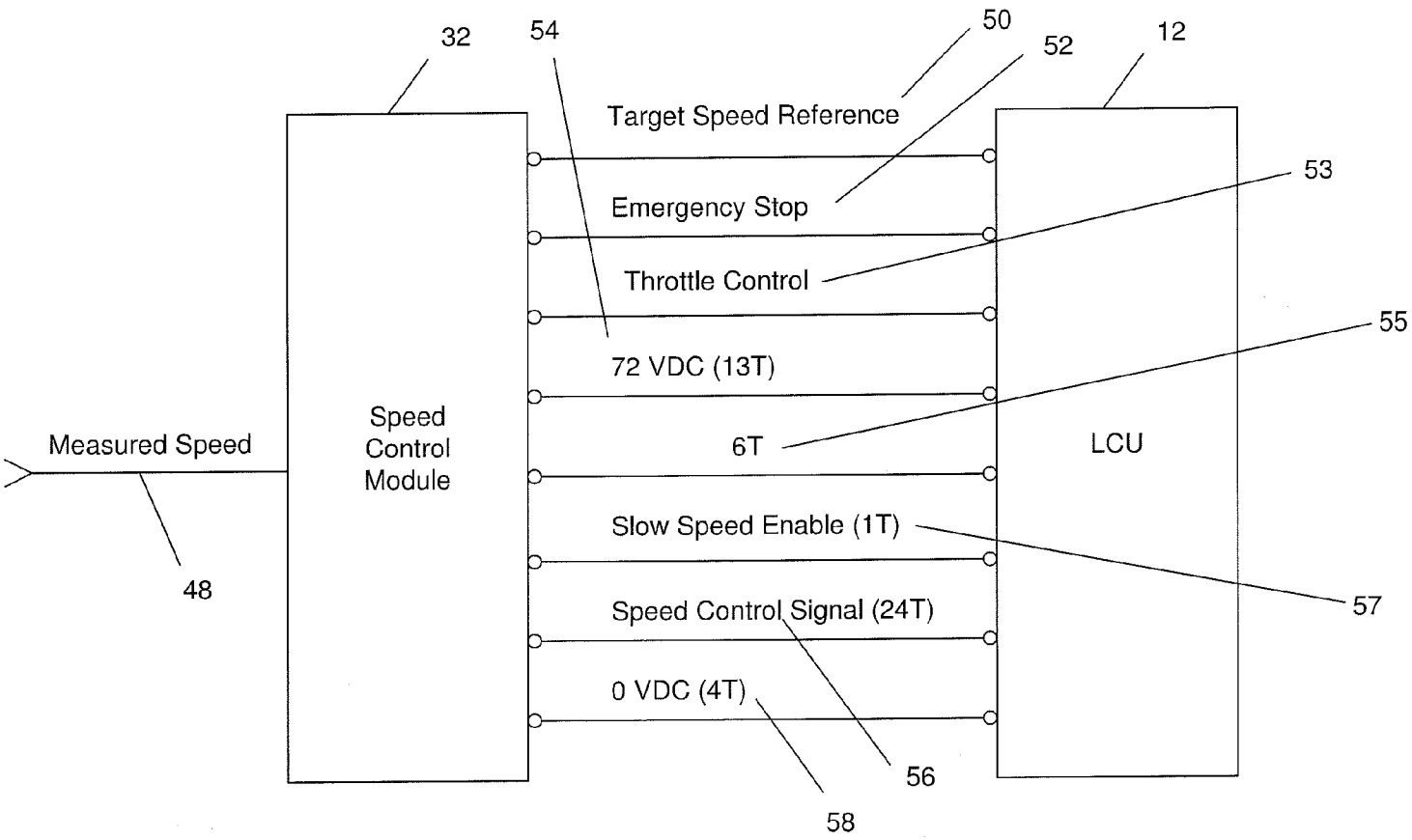
FIG. 5 is a schematic diagram showing connections between a speed control module and a remote control receiver for a portable remote control system for a locomotive.

To provide finer speed control, the remote control receiver 12, 12*a* is configured by an operator of the OCU 14 to set the LCU 12, 12*a* to operate the locomotive in a speed control mode. This should be done in a safe and secure manner. The operator may energize a source of power 54 to the speed control module 32, 42, by connecting the 72 VDC source provided by the 13T wire as shown in FIG. 5. The speed control module 32, 42 is also configured to connect to the 4T wire that provides 0 VDC as a zero volt reference 58, and to the 24T wire in order to provide a speed control signal 56 to the locomotive control system via the trainline. As also shown in FIG. 5, the speed control module 32 connects to the remote control receiver 12 to provide an emergency stop signal 52, which may be used to shut down the locomotive if, for example, an over speed condition is detected using an actual measured speed. The speed control module 32 also connects to the remote control receiver 12 to receive a target speed reference signal 50, which is communicated by the operator using the OCU 14. The speed control module 32 also receives a measured speed signal 48 from a primary speed measurement device 34 and, if applicable, a secondary speed measurement device 36. The speed control module 32 also connects to the LCU 12 for providing a throttle control 53, to connect to the 6T wire that provides the generator field contactor control 55 for the locomotive, and to connect to the 1T wires that provides a slow speed enable signal 57.

The operator of the OCU 14 communicates the desired speed setpoint to the remote control receiver 12, which is then provided to the speed control module 32 to control the locomotive's speed, by sending a speed control signal over the 24T wire. This can be done by a variety of methods. For example, a number pad, a rheostat or dial, or a number of preset switches (e.g., switch "A" ON=1.5 mph), may be used. The operator requested speed is thus communicated by the handheld controller 14 detecting an operator input and sending a signal over the wireless connection 16 to the remote control receiver 12, 12*a*. The remote control receiver 12, 12*a* having acknowledged the operator instruction, passes the targeted speed set point to the speed control module 32, 42, using the target speed reference signal 50. This can be done through a communication signal using readily available secure protocols (e.g., CANBUS); by use of an analog control signal, such as 0-10 volts or 4-20 milliamps; etc. The speed control module 32, 42 then uses the target speed reference signal 50 to generate a speed control signal 56 to send over the 24T wire. If necessary, the emergency stop signal 52 may be used to signal the LCU to place the locomotive in a "safe mode", where brakes are applied and power is removed from the locomotive's traction motors.

It can be appreciated that by using the portable remote control system's connection to the trainline, the 24T wire can be used to provide a speed control signal 56 to the locomotive control system as if the locomotive were being operated in its speed control mode, e.g., during loading and unloading cycles as discussed above. Taking advantage of the speed control mode also enables the handheld controller 14 to provide a finer speed control to the operator, as opposed to a coarse control that would be provided by controlling notch settings.

As discussed above, in addition to providing enhanced speed control to a portable remote control system 10, the speed control module 32, 42 can also be used to improve safety in portable remote control systems 10. This can be done by using an actual or true measured speed signal 48 to compare with the targeted or desired speed sent to the locomotive control system. In this way, an over speed condition or other undesirable outcome due to, for example, a corrupted or misinterpreted signal, can be avoided or cause a shut down of the locomotive.

Figure 6:
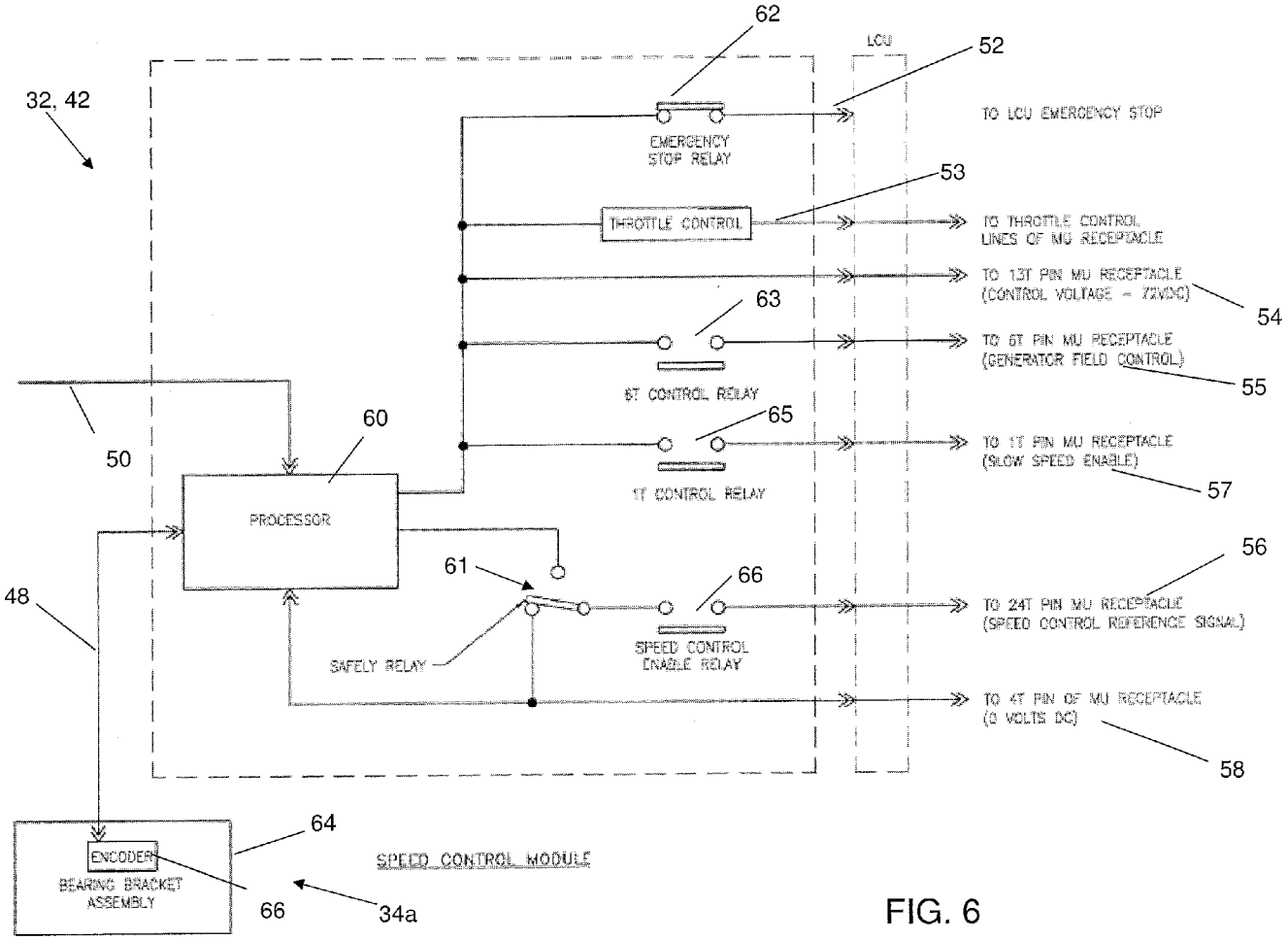
FIG. 6 is a schematic diagram illustrating an example configuration for a speed control module using a bearing bracket assembly and encoder as a speed measurement device.

FIG. 6 illustrates an example configuration for the speed control module 32, 42, which obtains a measured speed signal 48 from a first type of primary speed measurement device 34*a*, which includes an encoder 66 mounted to an axle bearing on the locomotive using a bearing bracket assembly 64. Use of the encoder 66 to obtain the speed of the locomotive directly from the rotation of the locomotive's axle, the incorporation of the speed control module 32, 42 into the portable remote control system 10 can be completely portable. The processor 60 shown in FIG. 6 may represent various components of the speed control module 32, 42, e.g., a voltage controller. The speed control module 32, 42 is powered by the source of power 54, e.g., the 13T pin as shown in FIG. 6. The processor 60 is operable to receive a measured speed signal 48 and, according to logic exemplified below, control an emergency stop relay 62 to provide the emergency stop signal 52, control a speed control enable relay 66 to provide the speed control signal 56, control a safety relay 61 to ensure a 0 VDC reading on the 24T wire by connecting the 24T wire to the zero volt reference 58, control the throttle using the designated wires on the MU receptacle identified by numeral 53, enable or disable the locomotive's generator field control 55 with the 6T control relay 63, and to control slow speed enable line 57 with the 1T control relay 65. The processor 60 also receives the target speed reference signal 50 from the remote control receiver 12, 12*a*.

Figure 7:
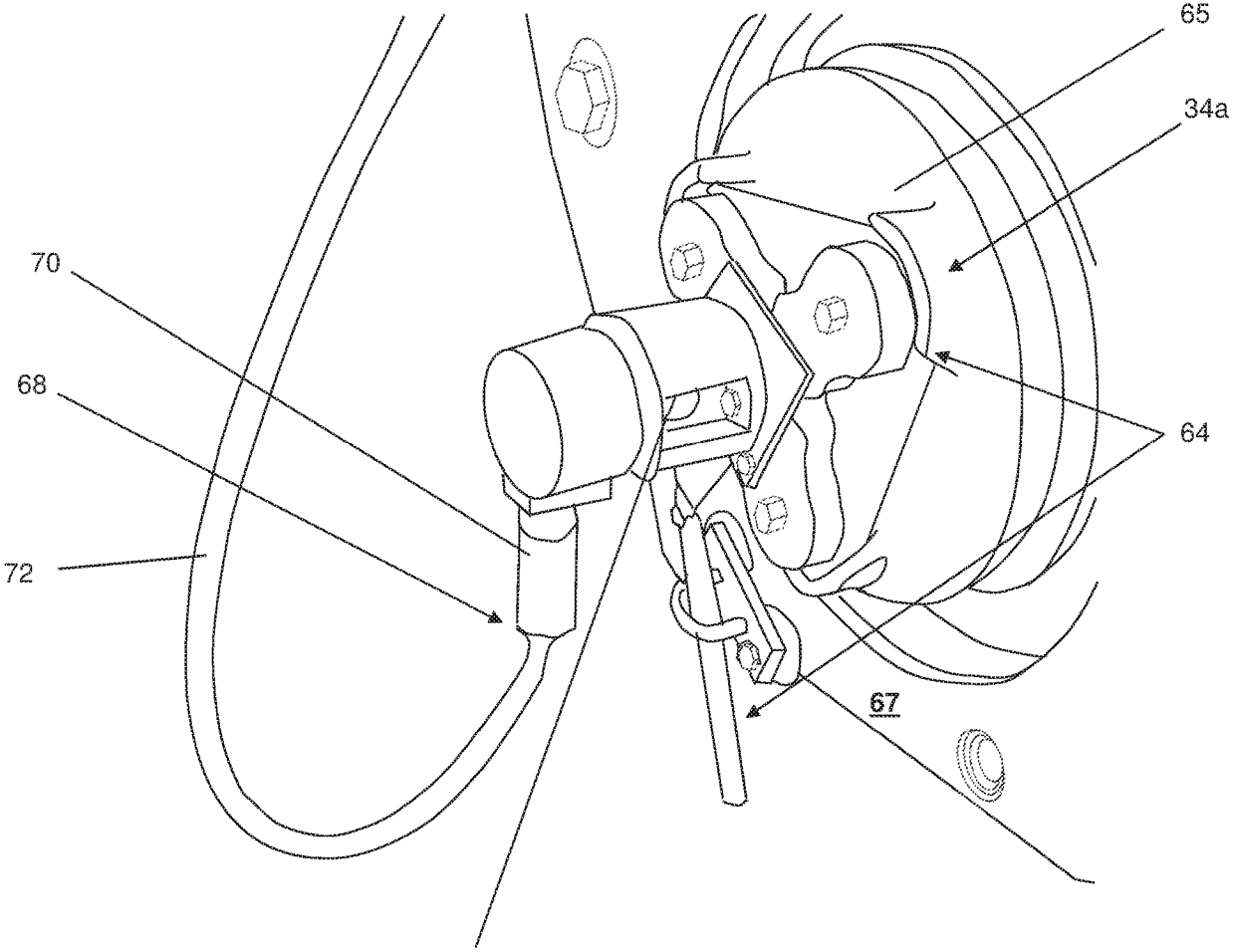
FIG. 7 is a perspective view of a speed measurement device using a bearing bracket assembly attached to a locomotive axle bearing and having an output cable.

An example of an embodiment of the bearing bracket assembly 64 and encoder 66 is shown in FIGS. 7 through 13. As can be seen from FIG. 7, the bearing bracket assembly 64 attaches in one portion to a bearing housing 65 of a locomotive axle to transfer rotation of the axle to the encoder 66 for determining an actual speed of the locomotive, and attaches in another portion to a stationary component of the locomotive to allow a shaft 98 of the encoder 66 (see also FIG. 9) to rotate relative to the encoder 66 itself. In the example shown in FIG. 7, the stationary component of the locomotive is any part of the truck assembly that is easily accessible, shown as a portion identified by numeral 67. As also shown in FIG. 7, a coupler or other suitable connector 68 is attached to the encoder 66 to enable a data cable 72 connected thereto to carry the measured speed signal 48 to the speed control module 32, 42. It can be appreciated that other equipment may be used to transmit the readings taken by the encoder 66 to the speed control module 32, 34, e.g., a wireless transmitter wherein the assembly 64 includes an integrated generator to power the encoder and communication electronics.

Figure 8:
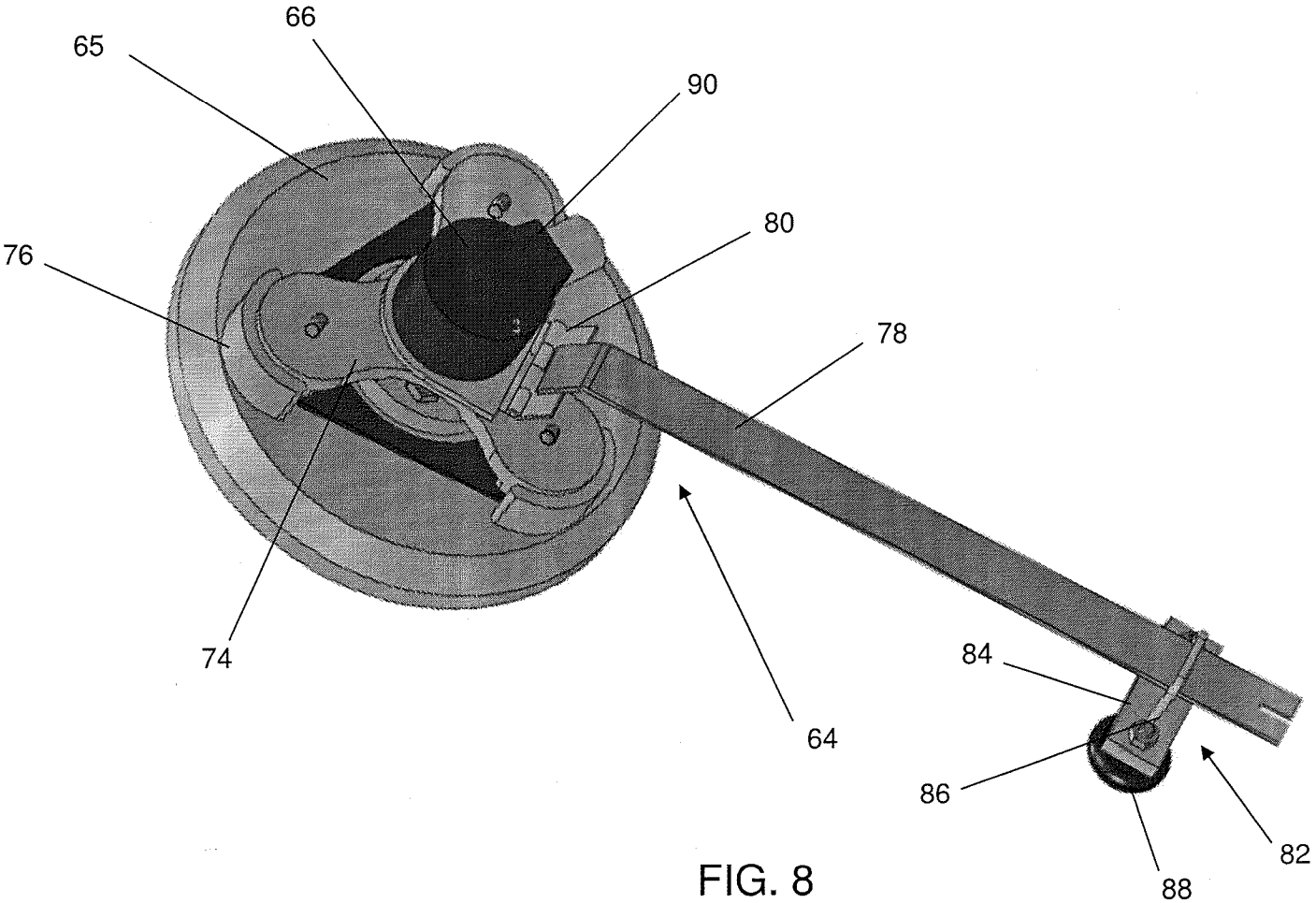
FIG. 8 is a perspective view of a speed measurement device attached to a locomotive axle bearing.
Figure 9:
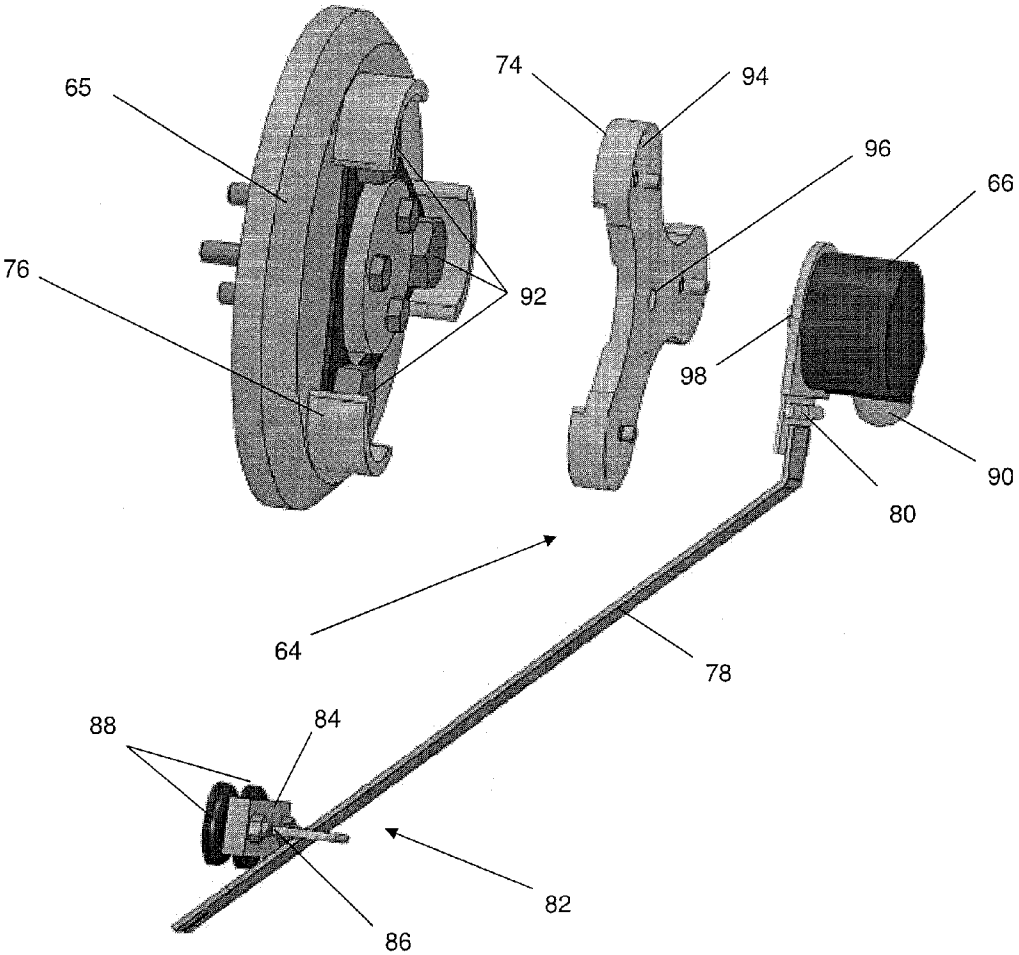
FIG. 9 is an exploded perspective view of the device of FIG. 8.
Figure 10:
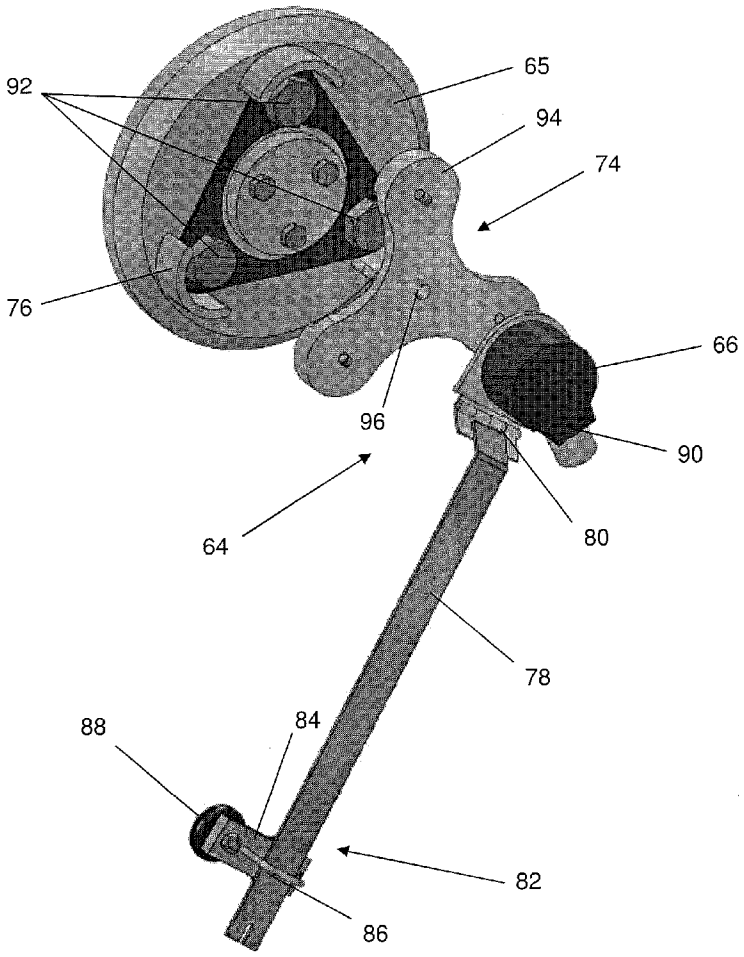
FIG. 10 is an exploded perspective view of the device of FIG. 8.
Figure 11:
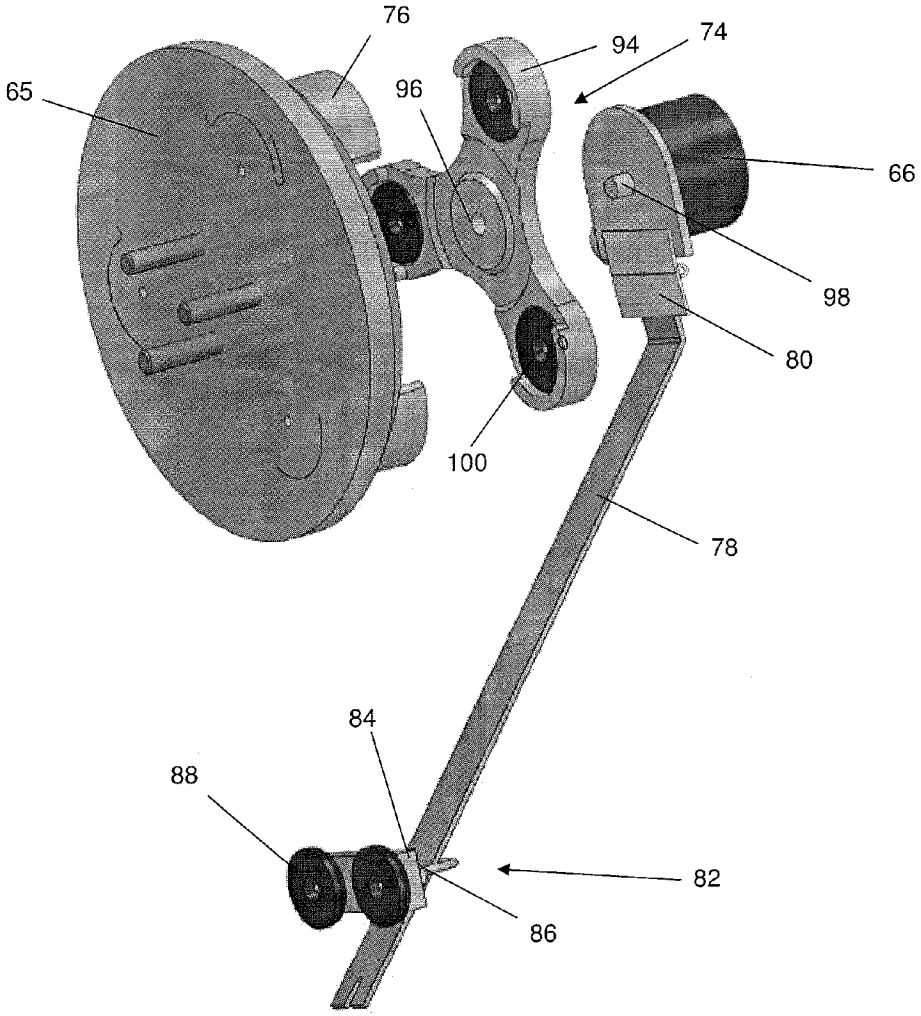
FIG. 11 is an exploded perspective view of the device of FIG. 8.
Figure 13:
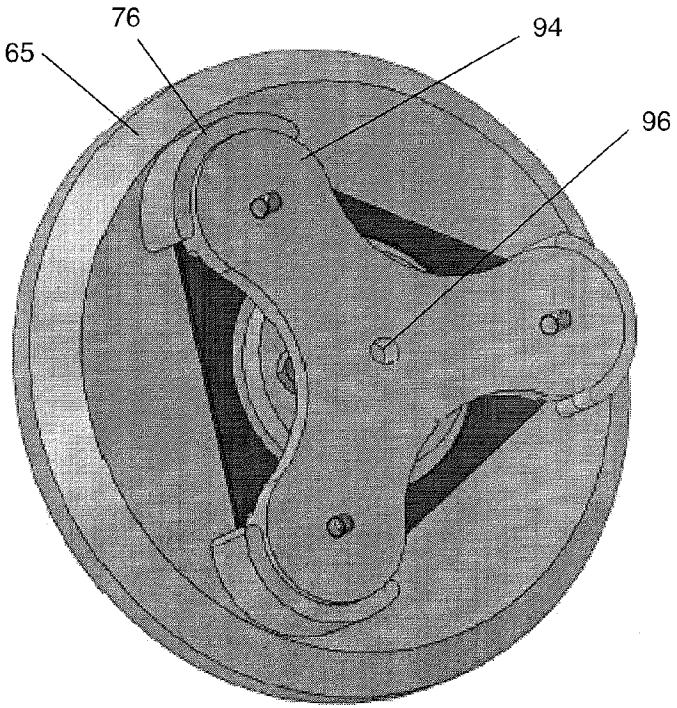
FIG. 13 is an isolated perspective view of a bearing bracket assembly of the device of FIG. 8 attached to exposed bolt heads of a locomotive axle bearing.
Figure 12:
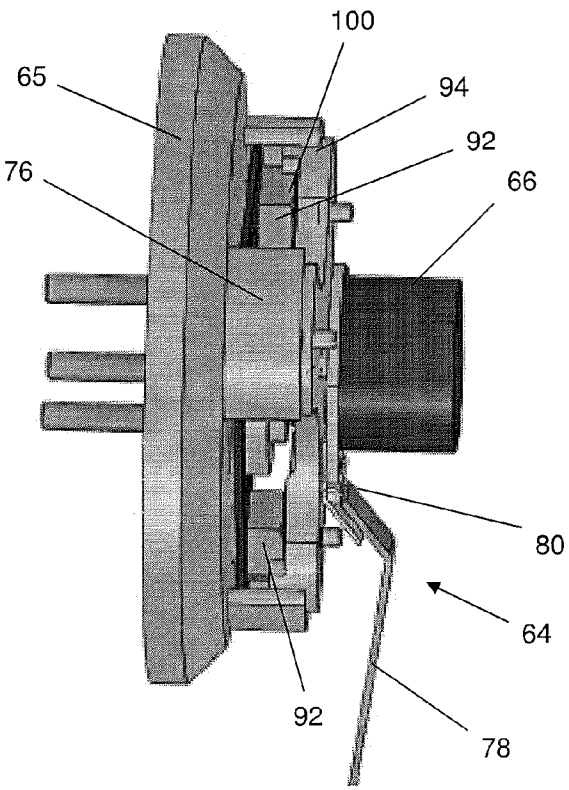
FIG. 12 is an elevation view of the device of FIG. 8.

As shown in FIGS. 8 and 9, the locomotive's axle bearing housing 65 is part of a bearing assembly that includes a series of bolts, each having a bolt head 92. It has been found that the bolt heads 92 provide suitable magnetic mounting points to which a mounting disc 74 of the bearing bracket assembly 64 can be attached. As seen in FIG. 11, the mounting disc 74 supports a magnet 100 corresponding to each bolt head 92 on a respective foot 94. The disc 74 may be shaped to minimize the material used, and to facilitate alignment of the magnets 100 and the bolt heads 92, e.g., in the trillium shape shown in the figures. The shape of the disc 74 may also be designed to encourage centering of the encoder 66 with the bearing housing 65. The use of the magnets 100 also prevents the need to disassemble the bearing assembly or otherwise modify an existing configuration, which may have safety concerns or otherwise detract from the portability and ease of assembly. The bolt heads 92 may have protector lips 76 and thus the mounting disc 74 should be sized and profiled to account for the area available to enable the magnets 100 to be mounted to the bolt heads 92.

The mounting disc 74 also includes a central aperture 96 through which the shaft 98 of the encoder 66 may be inserted in order to have the encoder 66 measure the rotation of the disc 74 to generate a speed measurement. To maintain the rotational position of the encoder 66 relative to the bearing housing 65, the encoder 66 is separately supported against a stationary portion of the locomotive in the vicinity of the bearing, e.g., the truck body 67 shown in FIG. 7. In the example shown, such support is provided by a stabilizer bar 78 that is attached at a first end to the encoder 66 using a hinged connection 80 to permit the stabilizer bar 78 to be adjustably positioned with respect to the locomotive. The stabilizer bar 78 is attached at a second end to an outrigger assembly 82 that includes a bracket 84 attached to the stabilizer bar 78 using a u-shaped bolt-on connector 86. The bracket 84 supports one or more magnets 86 that magnetically attach the outrigger assembly 82 to a stationary portion of the locomotive having magnetic properties. It can be appreciated that the magnets 100, 88 should be chosen to be strong enough to firmly secure the bearing bracket assembly 64 to both the bolt heads 92 and, e.g., the hub 67 such that the mounting disc 74 will rotate with the bearing while the encoder 66 is held stationary to enable a speed measurement to be determined. The magnets 88, 100 shown in the figures are only representative and may be interchanged with other components having similar magnetic properties, e.g., magnetic surfaces, coatings, etc. The magnets 88, 100 not only achieve such positioning, but also facilitate quick assembly and disassembly of the speed measurement device 34*a* to provide enhanced portability.

The bearing bracket assembly 64 may be provided with the encoder 66 already attached thereto (i.e. permanently or detachably connected) and installed for use by aligning the magnets 100 of the mounting disc 74 with the bolt heads 92 attached to the bearing housing 65. The stabilizer bar 78 may then be rotated until the magnets 88 of the outrigger assembly 82 are in contact with and thus magnetically attached to a magnetic, stationary surface such as the hub 67. The connector 70 is then connected to the encoder 66 and the data cable 72 (if a wired connection is used) attached to the speed control module 32, 42 to enable the speed measurement 48 to be provided thereto.

Figure 14:
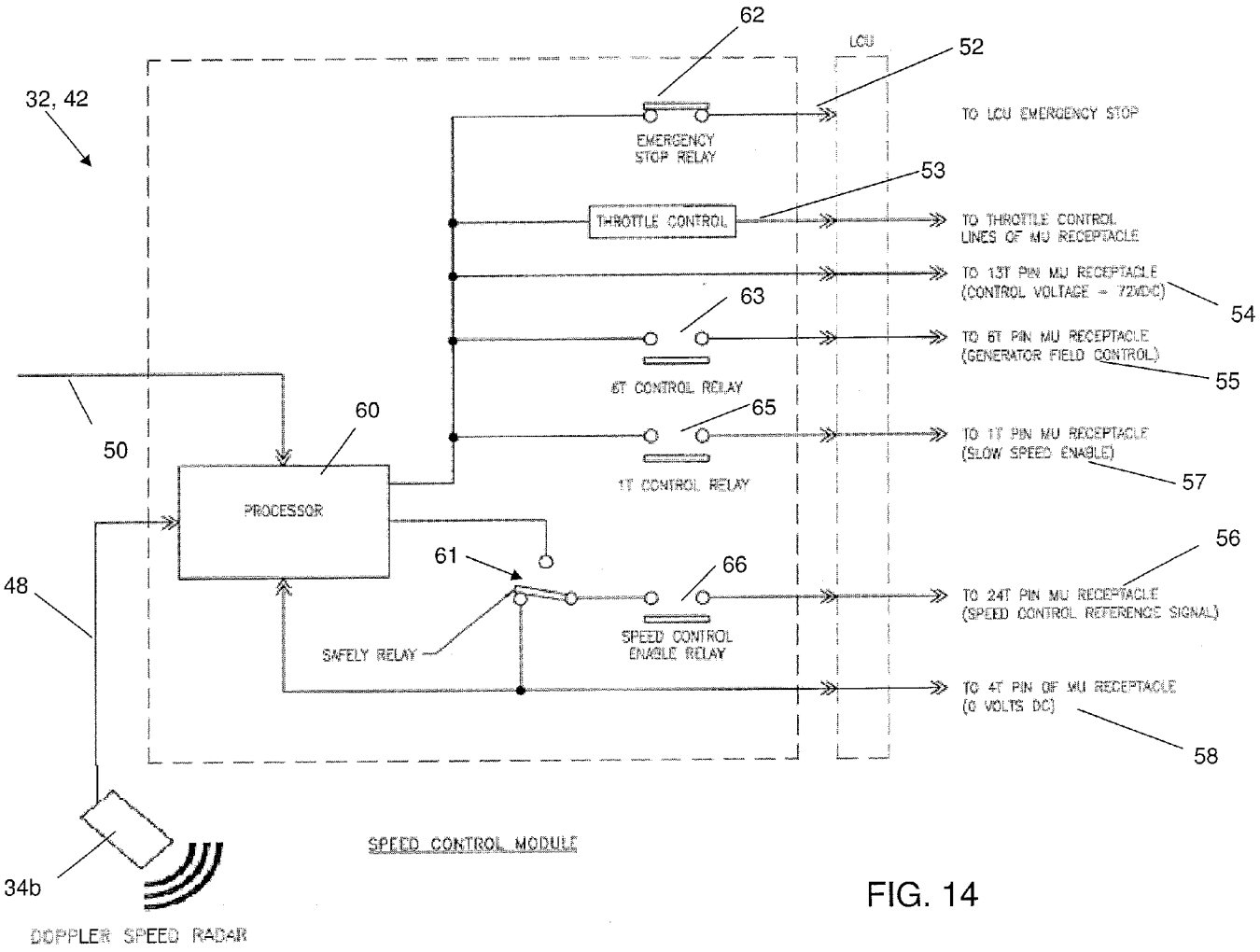
FIG. 14 is a schematic diagram illustrating an example configuration for a speed control module using a Doppler radar as a speed source.

Turning to FIG. 14, the speed control module 32 may also use other types of primary and/or secondary speed measurement devices 34, 36, such as a Doppler speed radar 34*b*. The Doppler speed radar 34*b* can be attached to the locomotive using various techniques such as bolts, magnets, or may utilize an already installed structure, unit or device on the locomotive. As discussed above, it can be appreciated that other speed measurement devices 34, 36 can also be used, such as GPS units, etc. These devices may have accuracy and signal integrity not as proficient as the encoder based speed signal described herein and thus may be selected for coarse speed control or to confirm the correct operation of the primary encoder based speed signal.

Figure 15:
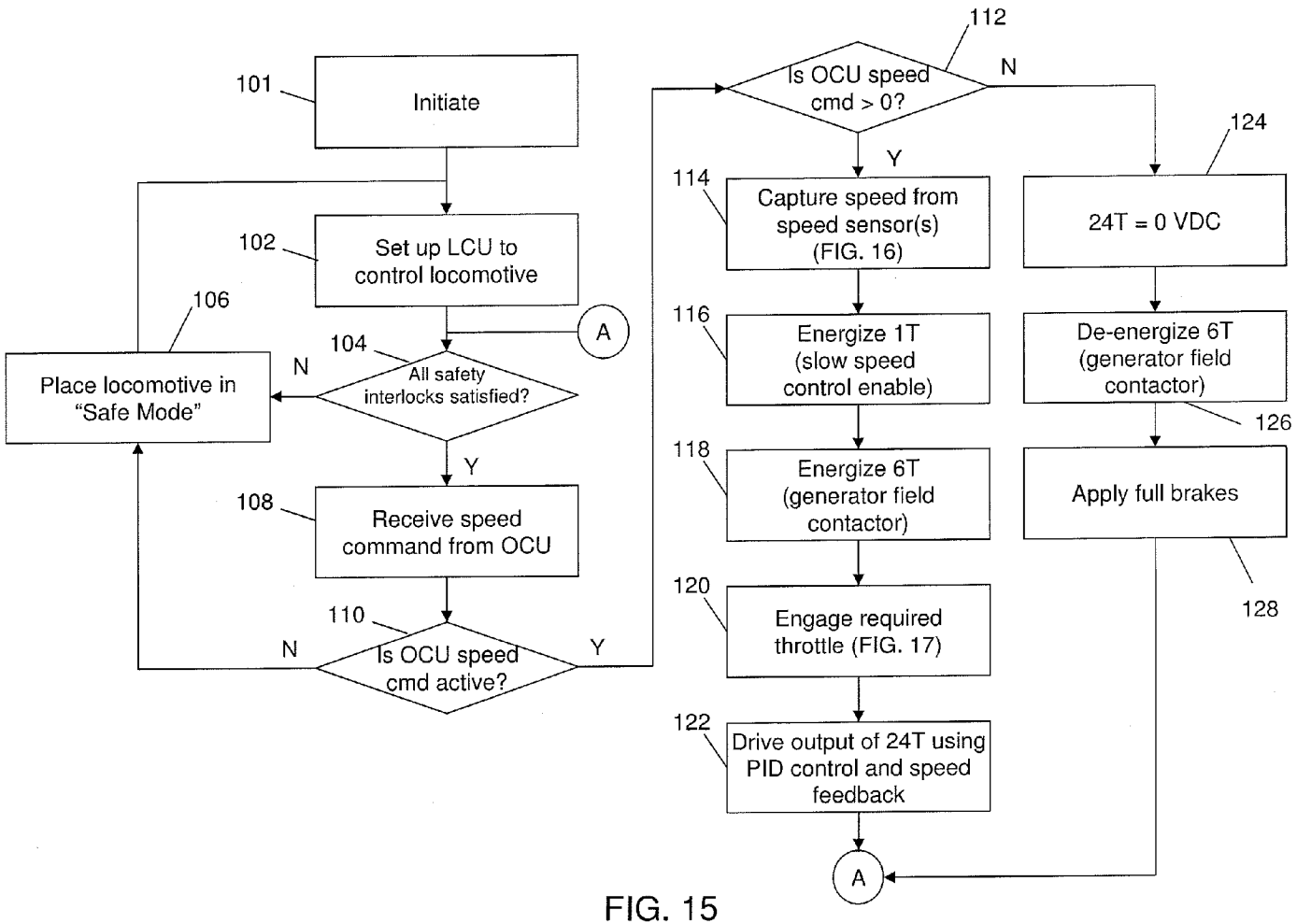
FIGS. 15 through 17 are flow diagrams illustrating computer executable operations that may be performed by a speed control module to provide speed control in a portable remote control system for a locomotive.
Figure 16:
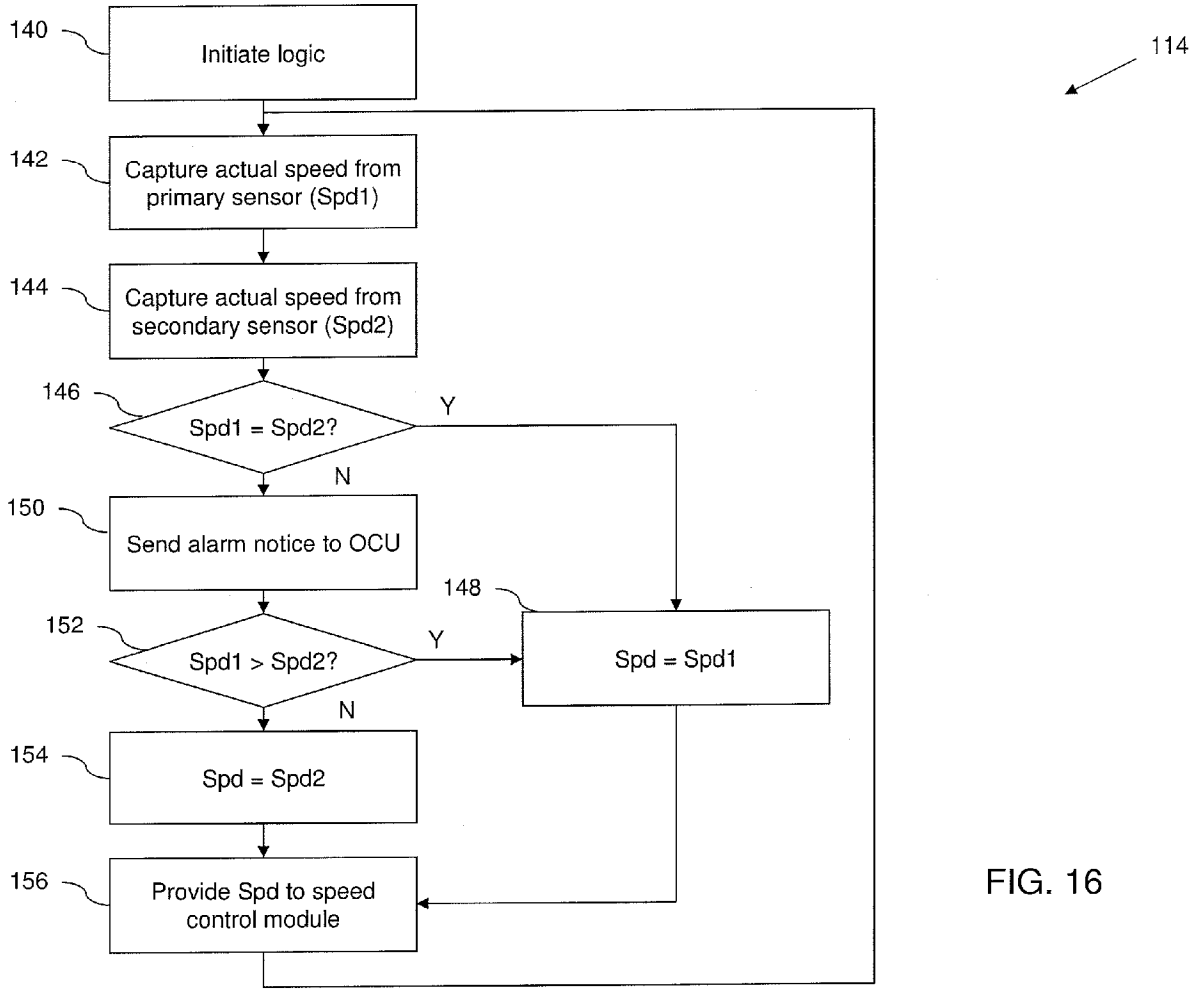
Figure 17:
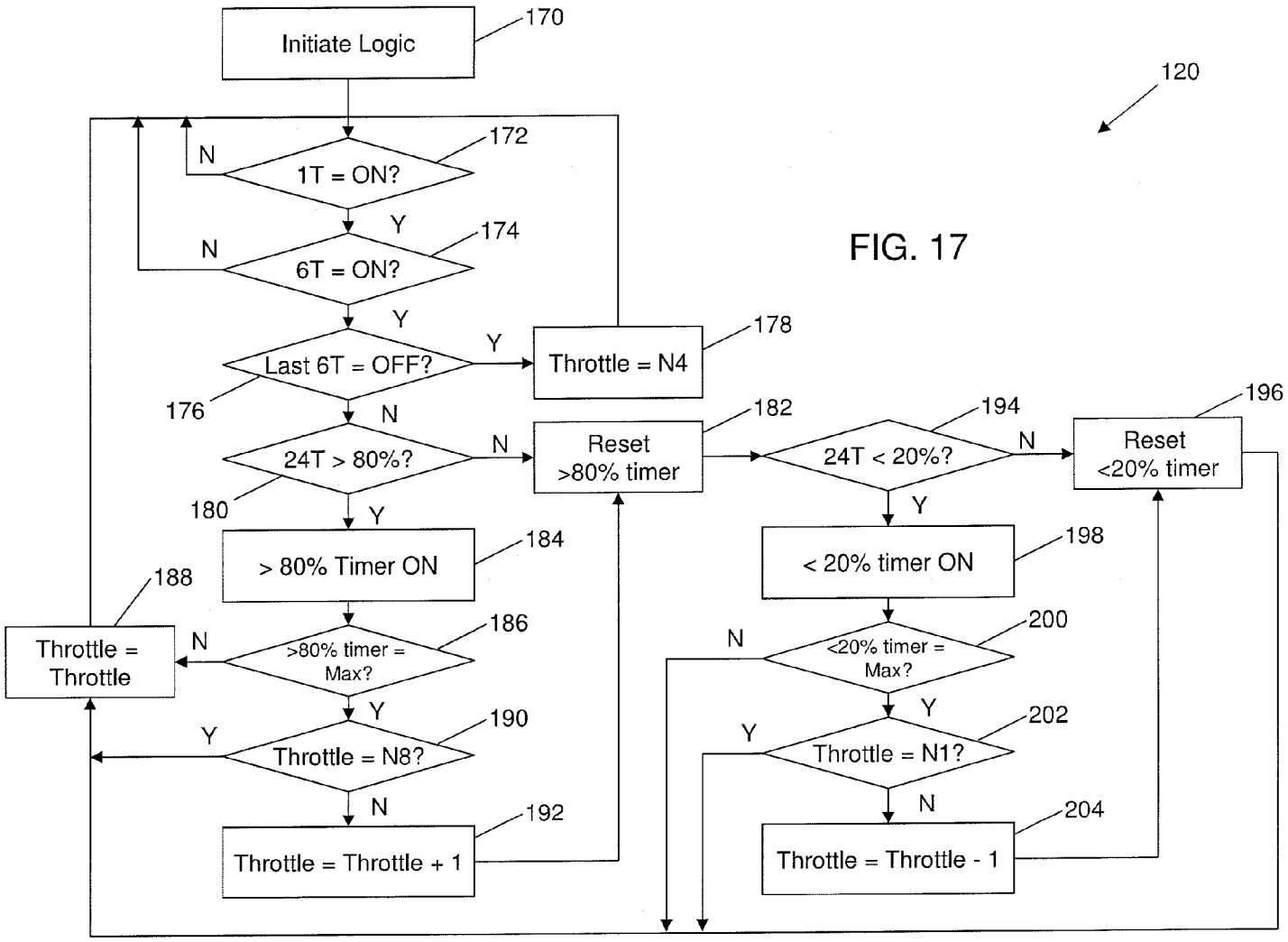

FIGS. 15 through 17 illustrate exemplary logic that may be executed by the speed control module 32, 42 in adapting a portable remote control system 10 for a locomotive to operate in a speed control mode and to incorporate various safety interlocks.

Referring first to FIG. 15, at 101 the speed control mode logic is initiated, which sets up or otherwise has the LCU control the locomotive at 102. The speed control module 32, 42 determines at 104 whether or not all safety interlocks, such as brake system air supply and traction power control interlocks, are satisfied. If not, the locomotive is placed in a "Safe Mode" at 106. If the safety interlocks are satisfied, the speed control module 32, 42 receives a speed command from the OCU 14 at 108 and determines at 110 whether or not the OCU's speed command (cmd) is active. The speed command is active when the OCU 14 is set up as speed control (vs. throttle and brake), all safety aspects of the OCU (i.e. tilt and alerter functions) and the signal integrity has been confirmed. If the speed command is not active, the locomotive is placed in the safe mode at 106. If the speed command is active, the speed control module 32, 42 determines at 112 whether or not the OCU's speed command indicates greater than zero. If the speed command is greater than zero, the speed control module 32, 42 captures a speed reading from the speed measurement devices 34, 36 at 114, further details of which are provided below in relation to FIG. 16. The speed control module 32, 42 then energizes the 1T pin of the MU at 116 to enable the slow speed control, and energizes the 6T pin at 118 for the generator field contactor. The speed control module 32, 42 engages the required throttle position at 120, as described in greater detail below in connection with FIG. 17.

The speed control module 32, 42 drives the output of the 24T pin at 122 using a proportional-integral-derivative (PID) control and a speed signal to achieve the targeted speed commanded from the OCU 14. The logic then proceeds along path A and returns to determine whether or not all safety interlocks are satisfied at 104. If the OCU speed command is not greater than zero as determined at 112, the speed control module 32, 42 sets the 24T pin to 0 VDC at 124 and de-energizes the 6T pin at 126 and applies full brakes at 128.

Turning now to FIG. 16, example operations are shown that may be executed at 114 in capturing the speed measurements from the speed measurement devices 34, 36. At 140 the logic for capturing the speed measurements is initiated and the speed control module 32, 42 captures the actual speed (Spd1) from the primary speed measurement device 34 at 142. The actual speed (Spd2) from the secondary speed measurement device 36 is also captured at 144. The speed control module 32, 42 determines at 146 whether or not Spd1 and Spd2 are equal or within an acceptable tolerance. If so, the locomotive's speed (Spd) is established using the Spd1 at 148. If Spd1 and Spd2 are not equal, the speed control module 32, 42 sends an alarm notice to the OCU 14 and then determines at 152 whether or not Spd1 is greater than Spd2. If so, Spd is set as Spd1 at 148. If not, Spd is set as Spd2 at 154. Once Spd is established, the Spd value is sent to the speed control module 32 at 156.

FIG. 17 illustrates example operations that may be performed at 120 in engaging a particular throttle (notch) position. At 170 the logic for engaging a throttle notch position is initiated. The speed control module 32, 42 determines at 172 whether or not the 1T pin is on. If not, the logic repeats until it is determined that the 1T pin is on. In other words, if there is no command for speed then there should be no requirement for horsepower and thus no engine throttle control. If the 1T pin is on, the speed control module 32, 42 determines at 174 whether or not the 6T pin is on. If not, the logic repeats until both the 1T and 6T pins are on. If the 6T pin is on, the speed control module 32, 42 determines whether or not the previous 6T setting was off, in other words, has there been a change of state for 6T. If so, the throttle position is set to be, for example, notch position 4 (N4) at 178. The purpose of establishing an initial throttle position is to allow the speed control to be initiated while mitigating the possibilities of bogging the engine. This value may change based on specific operating conditions of the railroad. If there has not been a change of state for pin 6T, the speed control module 32, 42 determines at 180 whether or not pin 24T has a reading that is greater than 80% of its maximum value. If not, the ">80% timer" is reset at 182, wherein if the excitation level is greater than (for example) 80%, it means that the system is near the horsepower limits for that notch position, meaning that there is little room to adapt if there is a step increase in load. The logic shown in FIG. 17 requests a higher throttle so that speed control is not compromised if there is a need for more horsepower to maintain speed. If pin 24T is reading greater than 80%, the >80% timer is set to be on at 184 and the speed control module 32, 42 determines at 186 whether or not the >80% timer is at a maximum time at 186, e.g., 20 seconds. If the >80% timer is not at the maximum time, the current throttle position is maintained at 188. If the >80% timer is at the maximum time, the speed control module 32, 42 determines at 190 whether or not the current throttle setting is notch 8 (N8). If so, the current throttle position is maintained as it cannot be increased. If the current throttle position is not N8, the throttle setting is increased by one notch position at 192 and the >80% timer reset at 182.

Since it is possible that the engine is operating at a throttle level too low for the speed requirement, it is also possible that the engine is operating at an inefficient, or too high a throttle position relative to the power requirements of the speed target. After resetting the >80% timer at 182, the speed control module 32, 42 determines at 194 whether or not the 24T pin is reading less than 20% of its maximum value. If not, a <20% timer is reset at 196. If the 24T pin is reading less than 20%, the speed control module 32, 42 turns the <20% timer on at 198 and determines at 200 whether or not the <20% timer is at its maximum time. If not, the current throttle position is maintained at 188. If the <20% timer is at its maximum time, the speed control module 32, 42 determines at 202 whether or not the current throttle position is at notch 1 (N1). If so, the current throttle position is maintained at 188 since the throttle cannot be lowered any further. If the throttle position is not N1, the current throttle position is lowered by one notch position at 204 and the <20% timer reset at 196.

As shown above, by configuring a locomotive control system to operate in a speed control mode via the 24T wire, and by utilizing the MU connection provided by a portable remote control system's remote control receiver 12, the portable remote control system 10 can be retrofitted or otherwise adapted or configured to provide portable remote speed control. In this way, the portable remote control system 10 can provide finer remote control over a locomotive's speed than control notch settings to achieve horsepower targets. Also, by obtaining a measured speed signal 48 from a primary and/or secondary speed measurement device 34, 36, 34*a*, 34*b*, safer operation of the speed control mode can be achieved by interlocking the portable remote control system 10 to prevent, for example, an over speed condition.

Figure 18:
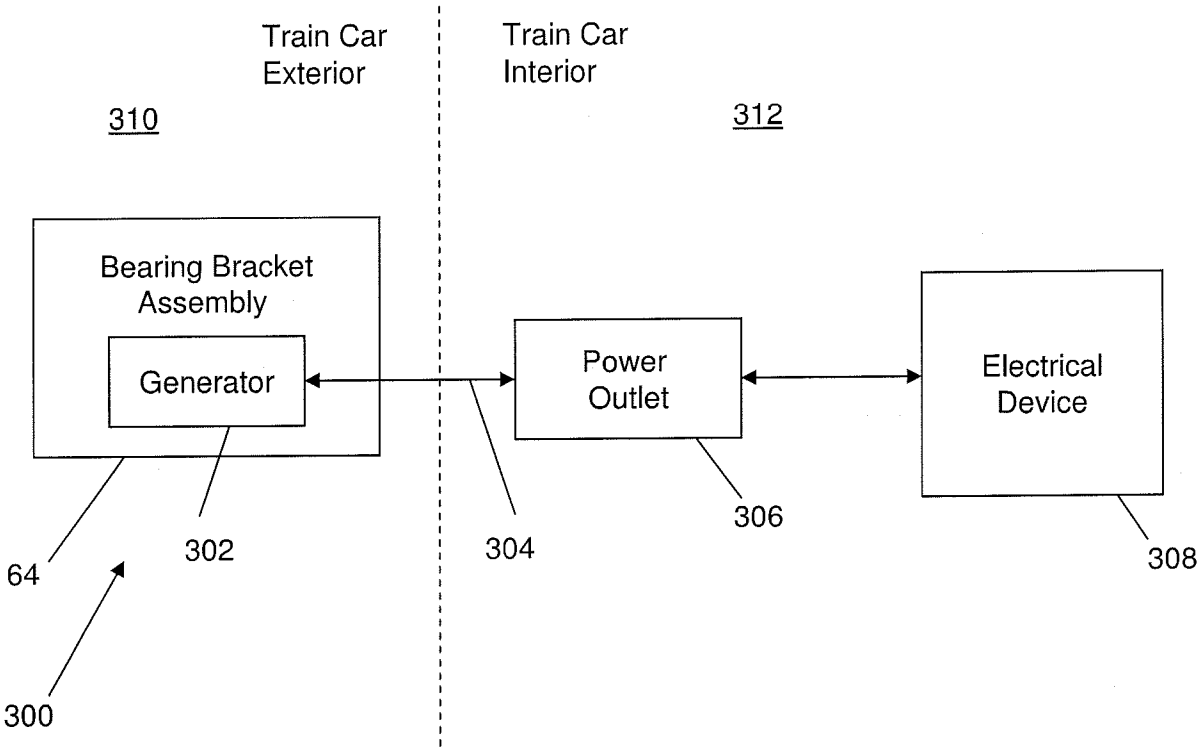
FIG. 18 is a schematic diagram illustrating a power generation device using a bearing bracket assembly and generator.

As discussed above, it has also been recognized that the bearing bracket assembly 64 can also be used to harness the rotation of a train car's axle to generate electrical power for a train car that does not already have an electrical power source. Turning to FIG. 18, a power generation assembly 300 is shown, which includes the bearing bracket assembly 64 with a generator 302 mounted thereto in the same location as the encoder 66 discussed above. By inserting a shaft of the generator 302 into the aperture 96 of the mounting disc 74, and attaching the stabilizer bar 78 and outrigger assembly 82 as discussed above, the generator 302 can generate electrical power from the rotation of the train car's axle. A suitable power cable 304 may then be attached to the generator 302 to feed electrical power to a power outlet 306 into which an electrical device 308 may be plugged. Examples of electrical devices 308 include sensors, recorders, transmitters, etc. It can be appreciated that the power cable 304 may also be connected directly to an electrical device 308. The bearing bracket assembly 64 can therefore be used not only to support an encoder 66 for obtaining speed measurements, but also to generate electrical power for a train car. For train cars that do not already have a source of power (or require electrical power to be fed from another car or locomotive), the generator 302 provides a way to cheaply harness an existing configuration of the train car to provide electrical power that would normally not be available.

It will be appreciated that the example embodiments and corresponding diagrams used herein are for illustrative purposes only. Different configurations and terminology can be used without departing from the principles expressed herein. For instance, components and modules can be added, deleted, modified, or arranged with differing connections without departing from these principles.

The steps or operations in the flow charts and diagrams described herein are just for example. There may be many variations to these steps or operations without departing from the principles discussed herein. For instance, the steps may be performed in a differing order, or steps may be added, deleted, or modified.

Although the above principles have been described with reference to certain specific example embodiments, various modifications thereof will be apparent to those skilled in the art as outlined in the appended claims.

The invention claimed is:

1. A mounting assembly comprising:

a mounting disc comprising at least one attachment component for detachably securing the mounting disc to the exterior of an axle bearing on a vehicle without disassembling the axle bearing, to enable the mounting disc to rotate with the axle bearing during movement of the vehicle while being detachable from the axle bearing for portability; and a stabilizer bar comprising a support at a first end thereof for supporting a device having a rotatable component to be rotatably attached to the mounting disc to transfer rotation of the axle bearing to the rotatable component, the support being axially aligned with the mounting disc and the axle bearing, the stabilizer bar being connected at a second end thereof to an outrigger, the outrigger comprising at least one attachment component for detachably securing the outrigger to a stationary component of the vehicle to maintain positioning of the support and the device to be mounted thereon, to enable the rotatable component to rotate with the mounting disc and axle bearing during movement of the vehicle relative to a body of the device which is held stationary by the stabilizer bar.

2. The mounting assembly of claim 1, the mounting disc further comprising an aperture sized to receive a rotating shaft of the device, the rotatable component comprising the rotating shaft.

3. The mounting assembly of claim 1, the stabilizer bar being attached to the mounting disc using a hinged connection.

4. The mounting assembly of claim 1, wherein the device comprises a speed measurement device comprising an encoder connected to the mounting disc via the rotatable component.

5. The mounting assembly of claim 4, interfaced with a speed control module connected to the encoder, the speed control module comprising a process and memory, the memory comprising computer executable instructions for providing speed control to a portable remote control system for a locomotive, the computer executable instructions comprising instructions for:

obtaining a target speed from a remote control receiver of the portable remote control system; and using a connection to a trainline on the locomotive provided by the remote control receiver to provide a speed control signal to a locomotive control system.

6. The mounting assembly of claim 5, further comprising instructions for:

obtaining a measured speed from the encoder interfaced with the locomotive using the mounting assembly;

comparing the measured speed to the target speed; and providing an emergency stop instruction when the measured speed exceeds the target speed.

7. The mounting assembly of claim 5 wherein the speed control module is retrofitted to the portable remote control system.

8. The mounting assembly of claim 5 wherein the speed control module is provided by logic included in the portable remote control system.

9. The mounting assembly of claim 5, wherein the speed control signal is provided on a 24T wire provided by a multiple unit (MU) connection.

10. The mounting assembly of claim 5, further comprising the speed control module.

11. The mounting assembly of claim 4, interfaced with a speed control module connected to the encoder, the speed control module comprising a process and memory, the memory comprising computer executable instructions for overriding a speed control mode operated by a portable remote control system for a locomotive, the computer executable instructions comprising instructions for:

obtaining a measured speed from the encoder interfaced with the locomotive using the mounting assembly;

comparing the measured speed to a target speed provided by the portable remote control system; and providing an emergency stop instruction to the portable remote control system when the measured speed exceeds the target speed.

12. The mounting assembly of claim 11, further comprising the speed control module.

13. The mounting assembly of claim 1, wherein the device comprises an electrical power generator device comprising a generator connected to the mounting disc via the rotatable component.

14. The mounting assembly of claim 1, wherein one or more of the at least one attachment component is magnetic.

15. The mounting assembly of claim 14, the mounting disc comprising a plurality of feet each supporting a magnet, the feet being spaced to permit alignment of the magnets with bolt heads on the axle bearing.

* * * * *